US007945180B2

(12) United States Patent
Kitami et al.

(10) Patent No.: US 7,945,180 B2
(45) Date of Patent: May 17, 2011

(54) APPARATUS AND METHOD FOR FORMING IMAGE

(75) Inventors: Kenji Kitami, Kashihara (JP); Yasunori Minakuchi, Nara (JP); Kenji Asakura, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 503 days.

(21) Appl. No.: 12/111,236

(22) Filed: Apr. 29, 2008

(65) Prior Publication Data

US 2008/0273887 A1 Nov. 6, 2008

(30) Foreign Application Priority Data

May 1, 2007 (JP) ..... 2007-121116

(51) Int. Cl.
*G03G 15/20* (2006.01)
*G03G 15/22* (2006.01)

(52) U.S. Cl. ..... 399/67; 399/68; 399/322; 399/400

(58) Field of Classification Search ..... 399/38, 399/67, 68, 320, 322, 400
See application file for complete search history.

(56) References Cited

U.S. PATENT DOCUMENTS 5,479,240 A * 12/1995 Lee et al. ..... 399/21
5,943,524 A * 8/1999 Eom ..... 399/18
6,766,120 B2 * 7/2004 Yokoi ..... 399/21
2003/0053811 A1 3/2003 Takayama
2006/0204265 A1 9/2006 Yoshikawa

FOREIGN PATENT DOCUMENTS

| | | | |
|---|---|---|---|
| JP | 11-249496 | | 9/1999 |
| JP | 2001-109326 | | 4/2001 |
| JP | 2001154527 A | * | 6/2001 |
| JP | 2003-98893 | | 4/2003 |
| JP | 2003-287932 | | 10/2003 |
| JP | 2005-227314 | | 8/2005 |
| JP | 2006-74968 | | 3/2006 |
| JP | 2006-251488 | | 9/2006 |
| JP | 2006-317822 | | 11/2006 |
| JP | 2007-010852 | | 1/2007 |
| JP | 2008-209567 | | 9/2008 |

* cited by examiner

*Primary Examiner* — David M Gray
*Assistant Examiner* — Fred Braun
(74) *Attorney, Agent, or Firm* — Renner, Otto, Boisselle & Sklar, LLP

(57) ABSTRACT

When an image forming apparatus, after a feeding error of a recording material occurs in a fixing device, re-forms on the recording material an image corresponding to image data which image was formed on a sheet which caused the feeding error, an image forming condition is caused to be different from an operation condition used when the feeding error has occurred. This makes it possible to prevent a JAM corresponding to the same image from recurring in the fixing device.

8 Claims, 9 Drawing Sheets

APPARATUS AND METHOD FOR FORMING IMAGE

This Nonprovisional application claims priority under 35 U.S.C. §119(a) on Patent Application No. 121116/2007 filed in Japan on May 1, 2007, the entire contents of which are hereby incorporated by reference.

FIELD OF THE INVENTION

The present invention relates to an image forming apparatus equipped with a fixing device. The present invention is particularly directed to a technique for avoiding that a JAM (a paper jam) recurs during printing the same data again after occurrence of a JAM in the fixing device of an image forming apparatus.

BACKGROUND OF THE INVENTION

An electrophotographic image forming apparatus is equipped with a fixing device which fuses and then fixes unfixed toner on recording paper.

Such a fixing device frequently uses the heat roller fixing method, in which a heat roller and a pressure roller are adopted. According to a fixing device that uses the heat roller fixing method, a heating source (heater) is provided either in a heat roller or both in the heat roller and in a pressure roller. The surfaces of both of the rollers are heated by the heating source. The heat of the rollers fuses unfixed toner, and the unfixed toner thus fused is then fixed on recording paper by the contact pressure between the heat roller and the pressure roller.

In recent years, efforts have been made to provide an image forming apparatus whose processing speed (paper feeding speed) is higher than before so that the number of sheets to be printed per unit of time increases. Therefore, according to image forming apparatuses of recent years, the time (passage time) required for recording paper to pass through a fixing nip section (a section where the heat roller makes contact with the pressure roller) becomes short. As such, the contact pressure between the heat roller and the pressure roller tends to be set high so that appropriate fixing performance is ensured even when the passage time is short. It is conceivable to improve the fixing performance by increasing a fixing nip width, instead of increasing the contact pressure, so that a great amount of heat is supplied to unfixed toner. This, however, causes a problem that the recording paper acquires wrinkles because the recording paper passes through a large contact pressure area.

On the other hand, if the contact pressure between the heat roller and the pressure roller is increased, the recording paper does not properly peel off from the heat roller due to the increased adhesiveness exerted between a printed surface of the recording paper and the heat roller. This causes a JAM (a fixing JAM) to tend to take place in the fixing device.

FIG. 6 is an explanatory diagram illustrating an example of a JAM which occurs in a fixing device of the heat roller fixing method. The fixing device 200 illustrated in FIG. 6 includes a heat roller 201, a pressure roller 202, a cleaning device 203, paper peeling nails 204*a* and 204*b*, heaters 205*a* to 205*c*, a heat roller cover 206, a pressure roller cover 207 and the like.

JAM examples 1 and 2 illustrated in FIG. 6 occur in the case in which a leading end of recording paper is not properly peeled off from the heat roller 201 by the paper peeling nail 204*a*. When there occurs a JAM such as JAM 1 or 2 in the fixing device, the user is in need of removing the recording paper that caused the JAM. This takes a lot of time and effort.

Further, in a case such as the JAM example 2, where the recording paper that caused the JAM is stuck in the heat roller cover 206, removing of the recording paper itself may be difficult. Furthermore, because the interior temperature of the fixing device is high immediately after a JAM occurs, the user needs to wait to remove the recording paper until the interior temperature of the fixing device becomes lower. This is time-consuming.

In a case where a JAM has occurred in the fixing device, it is normal that, after the user removes the recording paper that remains in the image forming apparatus, the same image that was printed on the sheet that caused the JAM is printed again (a printing retrial) on another recording paper under the same image forming conditions, under which the image was printed on the recording paper that caused the JAM (see, for example, Patent Document 1: Japanese Unexamined Patent Application Publication No. 251488/2006 (Tokukai 2006-251488; published on Sep. 21, 2006)).

FIG. 7 is a flow chart showing an example of a printing process performed by a conventional image forming apparatus. According to the example illustrated in FIG. 7, when a printing instruction (for example, a printer mode, a fax mode or a copier mode) is entered by a user (S101), an image process for printing is performed with respect to supplied image data (S102). Subsequently, the image data that has been subjected to the image process is temporarily stored in a memory (S103).

An image is printed onto a sheet in accordance with the image data that was stored in the memory in S103 (S104). During this step, it is determined based on detection whether or not a JAM has occurred during the printing process (S105). When it is determined that no JAM has occurred, it is determined whether or not there remains image data that has not been printed (S106). When it is determined that there remains such image data, the printing process of S104 is performed with respect to the image data that has not been printed. When it is determined that there remains no image data that has not been printed, the process is terminated.

When it is determined that a JAM has occurred in S105, the printing operation of the image forming apparatus is suspended (S107). Subsequently, it is displayed on a display section of the image forming apparatus where a JAM has occurred (S108). In accordance with the display, the user removes the sheet that caused the JAM and the sheet that remains in the apparatus. It is determined whether or not the sheet that caused the JAM and the paper that remains in the apparatus are removed (S109). When such sheets are removed, it is determined whether or not all attachments are attached to the image forming apparatus (whether or not each attachment is properly attached and the exterior lid is closed) (S110). When it is determined that all of the attachments are attached to the apparatus, the image forming apparatus is initialized (S111), and the printing process of S104 is performed again (reprinting process) in accordance with the image data that was stored in the memory in S103.

However, according to the conventional art, in a case of a JAM, the same image printed on the sheet that caused the JAM is printed again under the same image forming conditions, under which the image was printed on the sheet that caused the JAM. This causes a problem that recurrence of a JAM similar to the previous JAM is likely to occur.

In other words, in a case where the combination of image data and image forming conditions is likely to cause a JAM to occur in a fixing device of an image forming apparatus, it is most likely that a JAM similar to the previous JAM recurs when the printing is performed again under the same image forming conditions, under which the image was printed on the sheet that caused the JAM.

SUMMARY OF THE INVENTION

The present invention was accomplished in view of the above problem. It is an object of the present invention to prevent recurrence of a JAM concerning a same image in a fixing device.

In order to solve the above problem, an image forming apparatus of the present invention for forming on a recording material an image corresponding to image data, the image forming apparatus comprising: feeding means for feeding a recording material; image forming means for forming a toner image corresponding to image data, and for transferring the toner image onto the recording material; and fixing means for fixing on the recording material the toner image that was transferred by the image forming means, the image forming apparatus, further comprising: control means, when a feeding error of a recording material occurs in the fixing means and then an image corresponding to image data which was formed on the recording material which caused the feeding error of the recording material is re-formed on another recording material, for causing at least one of operation conditions under which said each means works when an image is formed to be different from an operation condition used when the feeding error has occurred.

In order to solve the above problem, an image forming method of the present invention for forming on a recording material an image corresponding to image data by use of an image forming apparatus, the image forming apparatus comprising: feeding means for feeding a recording material; image forming means for forming a toner image corresponding to image data, and for transferring the toner image onto the recording material; and fixing means for fixing on the recording material the toner image that was transferred by the image forming means on the recording material, which image was transferred onto the recording material, the image forming method comprising the step of: when a feeding error of a recording material occurs in the fixing means and then an image corresponding to image data which was formed on the recording material which caused the feeding error of the recording material is re-formed on another recording material, causing at least one of operation conditions under which said each means works when an image is formed to be different from an operation condition used when the feeding error has occurred.

According to the image forming apparatus and the image forming method, after a feeding error of recording material occurs in the fixing means, the image corresponding to the image data concerned when the feeding error occurred is formed again on the recording material. In this case, at least one of the operational conditions of forming an image in the above means is set so that such a condition is different from the condition applied when the feeding error occurred. As described above, by forming the same image again in operational conditions different from the conditions under which the feeding error occurred, the possibility of a feeding error recurring in the fixing means can be lowered. Such lowered possibility of a feeding error recurring can contribute to improved efficiency in the image forming process, reduced waste of recording material, toner and power consumption, reduced running costs, and a longer life of the fixing device resulting from reduced loads.

Additional objects, features, and strengths of the present invention will be made clear by the description below. Further, the advantages of the present invention will be evident from the following explanation in reference to the drawings.

DESCRIPTION OF THE EMBODIMENTS

Figure 2:
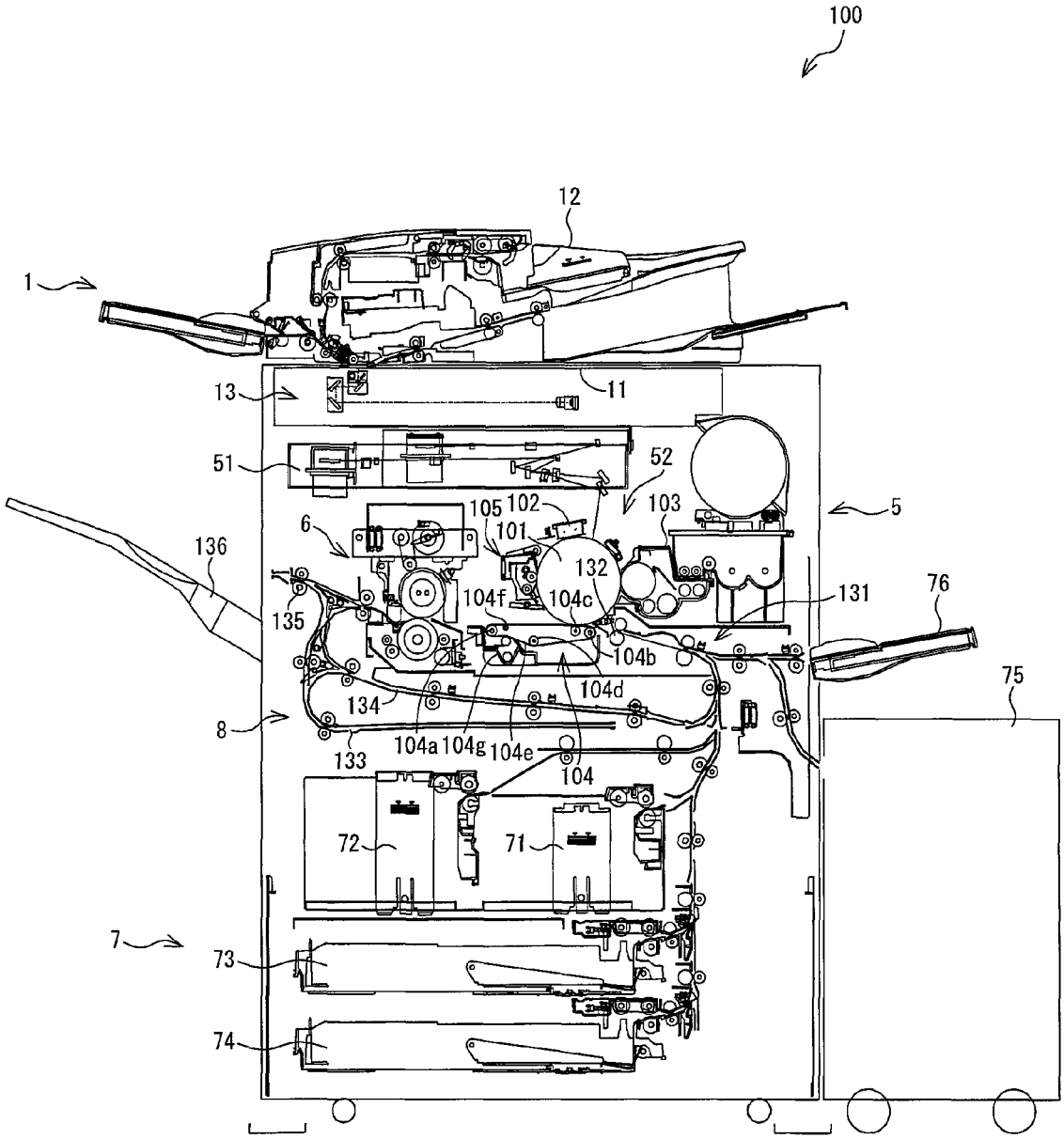
FIG. 2 is a cross-sectional view of a multifunctional apparatus of an embodiment in accordance with the present invention.
Figure 3:
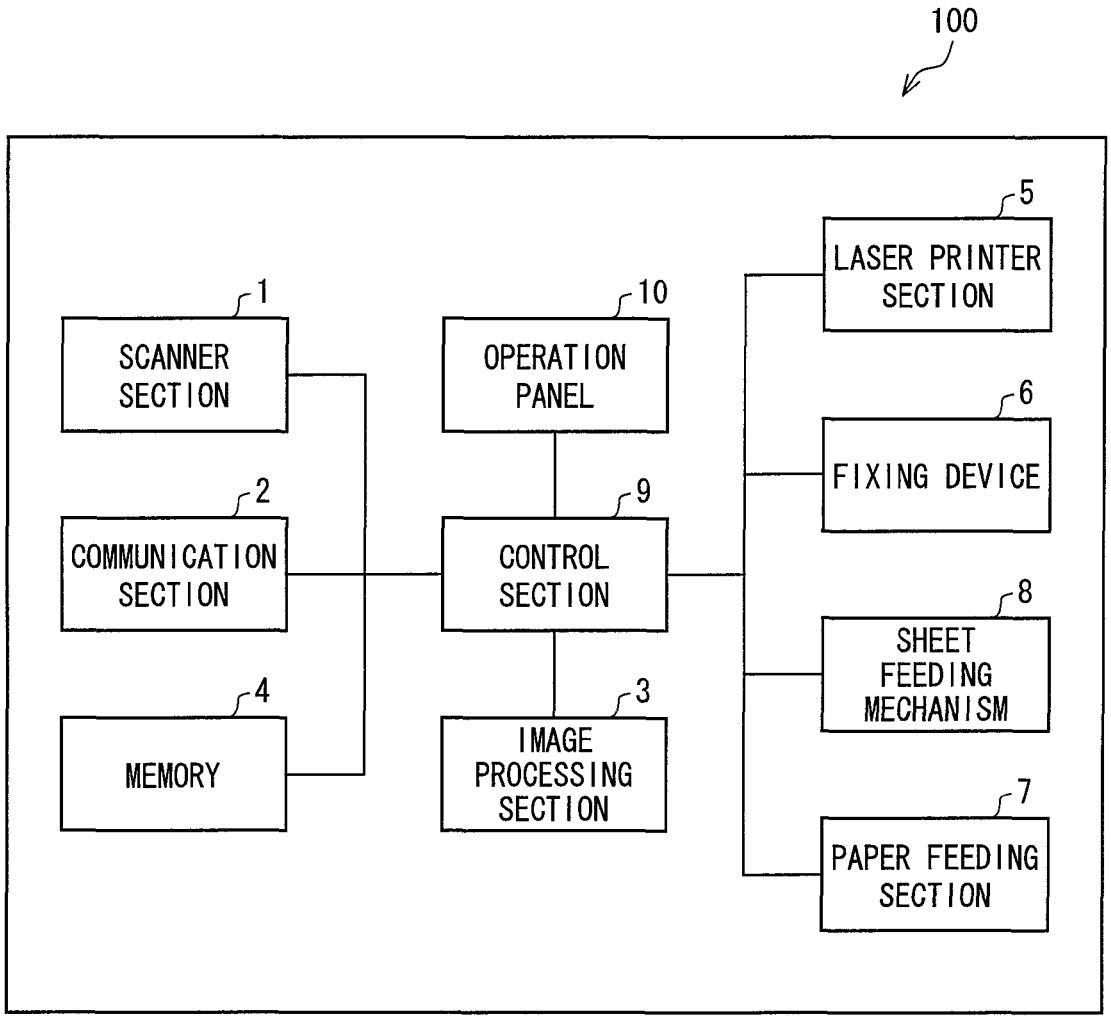
FIG. 3 is a block diagram illustrating a multifunctional apparatus of an embodiment in accordance with the present invention.

One embodiment of the present invention is described below with reference to drawings. FIG. 2 is a cross-sectional view showing a schematic arrangement of a multifunctional apparatus 100 in accordance with the present embodiment. FIG. 3 is a block diagram illustrating functions of the multifunctional apparatus 100. The multifunctional apparatus 100 can function as a copying machine, a printer or a facsimile machine.

[Arrangement of the Multifunctional Apparatus 100]

As illustrated in FIGS. 2 and 3, the multifunctional apparatus 100 includes a scanner section 1, a communication section 2, an image processing section 3, a memory 4, a laser printer section 5, a fixing device 6, a paper feeding section 7, a sheet feeding mechanism 8, a control section 9 and the like.

The scanner section 1 includes: a scanner platen 11, which is made of transparent glass; a Recirculating Automatic Document Feeder (RADF) 12, which automatically feeds a sheet onto the scanner platen 11; and a scanner unit 13, which scans the sheet set on the scanner platen 11. The image data of the sheet scanned in the scanner section 1 is supplied to the image processing section 3. After a predetermined image process is performed with respect to the image data in the image processing section 3, the image data is temporarily stored in the memory 4. Subsequently, the control section 9 controls each section of the multifunctional apparatus 100 in accordance with the image data stored in the memory 4. As a result, an image corresponding to the image data is formed on a sheet (recording material).

The communication section 2 communicates with an external apparatus such as a personal computer or a facsimile machine by radio communication or cable communication. An image received by the communication section 2 from an external apparatus is temporarily stored in the memory 4. Alternatively, an image received by the communication section 2 from an external apparatus may be subject to a predetermined image process in the image processing section 3 and then temporarily stored in the memory 4. Subsequently, the control section 9 controls operation of each section of the multifunctional apparatus 100 in accordance with the image data stored in the memory 4. As a result, an image corresponding to the image data is formed on a sheet.

As illustrated in FIG. 2, the paper feeding section 7 includes cassette paper feeding devices 71 to 74, a large-capacity paper feeding device 75 and a manual paper feeding device 76. The cassette paper feeding devices 71 to 74 store sheets (recording material) on which an image is formed, and are disposed, in the multifunctional apparatus 100, on a side wall surface underneath the multifunctional apparatus 100. In a tray of each of the cassette paper feeding devices 71 to 74, 500 to 1500 sheets of a standard size can be stored. The large-capacity paper feeding device 75 can store a large amount of paper of plural kinds, and is disposed on a side of the main body of the multifunctional apparatus 100. The manual paper feeding device 76 is used to feed a sheet of any size and material inserted by a user, and disposed on the side of the main body of the multifunctional apparatus 100. Each of the paper feeding devices is arranged so as to feed one of the stored sheets at a time to the laser printer section 5.

The laser printer section 5 forms an image corresponding to image data on a sheet fed by the paper feeding section 7. As illustrated in FIG. 2, the laser printer section 5 includes an exposure unit 51 and an electrophotographic printing process section 52.

In accordance with image data, the exposure unit 51 irradiates with laser light a photosensitive drum (an image bearing body) 101, which is provided in the electrophotographic printing process section 52, so that an electrostatic latent image corresponding to the image data is formed on the photosensitive drum 101. According to the present embodiment, as illustrated in FIG. 2, a laser scanning unit which is equipped with a laser irradiation section and reflection mirrors is used as the exposure unit 51. However, the exposure unit 51 of the present invention is not limited to this. Alternatively, an exposure unit, equipped with a writing head which is formed by arranging in an array light-emitting elements such as an OLED and an LED, may be used. In the present embodiment, in order to perform a high-speed printing process, the speeding-up of irradiation timing is reduced by use of a plurality of laser beam sources (the two beam method).

The electrophotographic printing process section 52 includes the photosensitive drum 101, a charging device 102, which is disposed around the photosensitive drum 101, a development device 103, a transfer device 104, a peel-off device (not shown), a cleaning device 105 and a charge removing device (not shown). The present embodiment describes an arrangement in which a single electrophotographic printing process section 52 is provided so that monochrome printing is performed. However, the present invention is not limited to this. Therefore, a plurality of the electrophotographic printing process sections 52 may be provided so that color printing can be performed.

The charging device 102 charges a surface of the photosensitive drum 101 uniformly so that a predetermined electric potential is applied to the surface. In the present embodiment, as illustrated in FIG. 2, a non-contact type charging device is used as the charging device 102. However, the present embodiment is not limited to this. Therefore, for example, a contact type (a roller type, a brush type or other type) charging device may be used instead.

The development device 103 develops an electrostatic latent image formed on the photosensitive drum 101 by the exposure unit 51 so as to form a toner image.

The transfer device 104 electrostatically transfers onto a sheet (recording material) the toner image formed on the photosensitive drum 101 by the development device 103. Specifically, the electric potential of an area of the transfer device 104, which area is opposite to the photosensitive drum 101, is applied with a sheet in between the photosensitive drum 101 and the transfer device 104 so as to have a polarity reverse to that of the electric potential of the toner image on the photosensitive drum 101. This causes the toner image on the photosensitive drum 101 to be transferred onto the sheet. For instance, when the toner image on the photosensitive drum 101 has a negative charge, a positive charge is applied to the transfer device 104.

According to the present embodiment, a transfer belt unit is used as the transfer device 104. The transfer belt unit includes a driving roller 104*a*, a driven roller 104*b*, a transfer roller 104*c*, a tension roller 104*d*, a charge removing roller 104*f*, a transfer belt 104*e* causing the rollers to engage with each other, and a cleaning unit 104*g*.

The transfer belt 104*e* is an endless belt which has a predetermined resistance value which falls within a range of $1\times10^{9}$ Ω·cm to $1\times10^{13}$ Ω·cm).

The transfer roller (an electrically conductive elastic roller) 104*c* is disposed so as to be in contact with the transfer belt 104*e*, from a side opposite to a side from which the photosensitive drum 101 is in contact with the transfer belt 104*e*, in an area where the photosensitive drum 101 and the transfer belt 104*e* are in contact with each other. The transfer roller 104*c* is made of elastic material which has electric conductivity different from the electric conductivity of the driving roller 104*a* and of the driven roller 104*b*. Applied to the transfer roller 104*c* is an electric potential of a polarity reverse to that of the toner image that is formed on the photosensitive drum 101. This causes a transfer electric field to be generated between the photosensitive drum 101 and the transfer roller 104*c*. Since the transfer roller 104*c* has elasticity, the contact between the photosensitive drum 101 and the transfer roller 104*c* are not a line contact (one-dimensional contact) but a face contact (two-dimensional contact) having a predetermined width (a transfer nip). Because of this, a toner image on the photosensitive drum 101 can be efficiently transferred onto a sheet.

The charge removing roller 104*f* is disposed so as to abut on the rear surface of a sheet (the rear surface of a surface onto which a toner image is transferred) further downstream in a sheet feeding direction as compared with the transfer region (a region where the photosensitive drum 101 and the transfer roller 104*c* are opposite to each other). The charge removing roller 104*f* removes electric charge applied to the sheet in the transfer region. This allows the sheet to be smoothly fed for the next step.

The cleaning unit 104*g* removes dirt such as toner adherent to the transfer belt 104*e* and removes the electric charge of the transfer belt 104*e*. A charge removing method is not limited to a specific one. For instance, the transfer belt 104*e* may be grounded. Alternatively, the electric charge of the transfer belt 104*e* may be removed by applying an electric potential which has a polarity reverse to that of the electric charge of the transfer belt 104*e*.

The cleaning device 105 removes and gathers toner which remains on the surface of the photosensitive drum 101 after the toner image is transferred.

The fixing device 6 fixes a toner image (an unfixed toner image) on a sheet which toner image was transferred onto the sheet by the electrophotographic printing process section 52. The fixing device 6 will be explained below in detail.

As illustrated in FIG. 2, the sheet feeding mechanism 8 includes a feeding section 131, an idle roller 132, a sheet reversing section 133, a refeeding path 134, a paper output roller 135 and a paper output tray 136.

The feeding section 131 includes a sheet feeding path and multiple feeding rollers. The feeding section 131 feeds a sheet fed by the paper feeding section 7 to the transfer region of the electrophotographic printing process section 52 so that a toner image is transferred onto the sheet, and then feeds the sheet on which the toner image was transferred to the fixing device 6 so that the toner image is fixed on the sheet. Further, the feeding section 131 feeds the sheet outputted from the fixing device 6 either to the paper output roller 135 or to the sheet reversing section 133.

The feeding section 131 further includes a plurality of sheet sensors (not shown) which detect the location of a sheet fed. The detection result gained in each of the sheet sensors is sent to the control section 9. The control section 9 controls operation timing of each section, based on the location of the sheet thus detected and the timing of the detection. Furthermore, in a case of a JAM, the control section 9 determines, in accordance with the detection result, that the JAM has occurred and where the JAM has occurred. For instance, in a case where the timing at which the front end or the rear end of a sheet passes a point where the sheet sensor performs its detection is delayed in comparison with the normal timing, the control section 9 determines that a JAM has occurred.

The idle roller 132 temporarily stops a sheet fed by the feeding section 131 and then sends out the sheet thus temporarily stopped to the transfer region so that (i) the timing at which a toner image formed on the photosensitive drum 101 reaches the transfer region and (ii) the timing at which the location of the toner image transfer on the sheet reaches the transfer region synchronize exactly with each other.

The sheet reversing section 133, in the case of two-sided printing, reverses the sheet outputted from the fixing device 6 and then outputs the sheet to the refeeding path 134. The refeeding path 134 includes a sheet feeding path and multiple feeding rollers. The refeeding path 134 feeds the sheet outputted from the sheet reversing section 133 toward further upstream in the feeding section 131 as compared with the idle roller 132. As a result, the sheet thus reversed is fed again to the transfer region, and an image is formed on both sides of the sheet. The paper output roller 135 outputs to the paper output tray 136 the sheet which is outputted from the fixing device 6. The paper output tray 136 is disposed on a side surface of the multifunctional apparatus 100 which side surface is opposite to a side surface on which the manual paper feeding device 76 is disposed. Note that, in place of the paper output tray 136, a finishing process device may be provided which performs processes such as a stapling process, a punching process, and/or a sorting process. Alternatively, a plurality of paper output trays may be provided so that a sheet is outputted onto one of the paper output trays.

Figure 8:
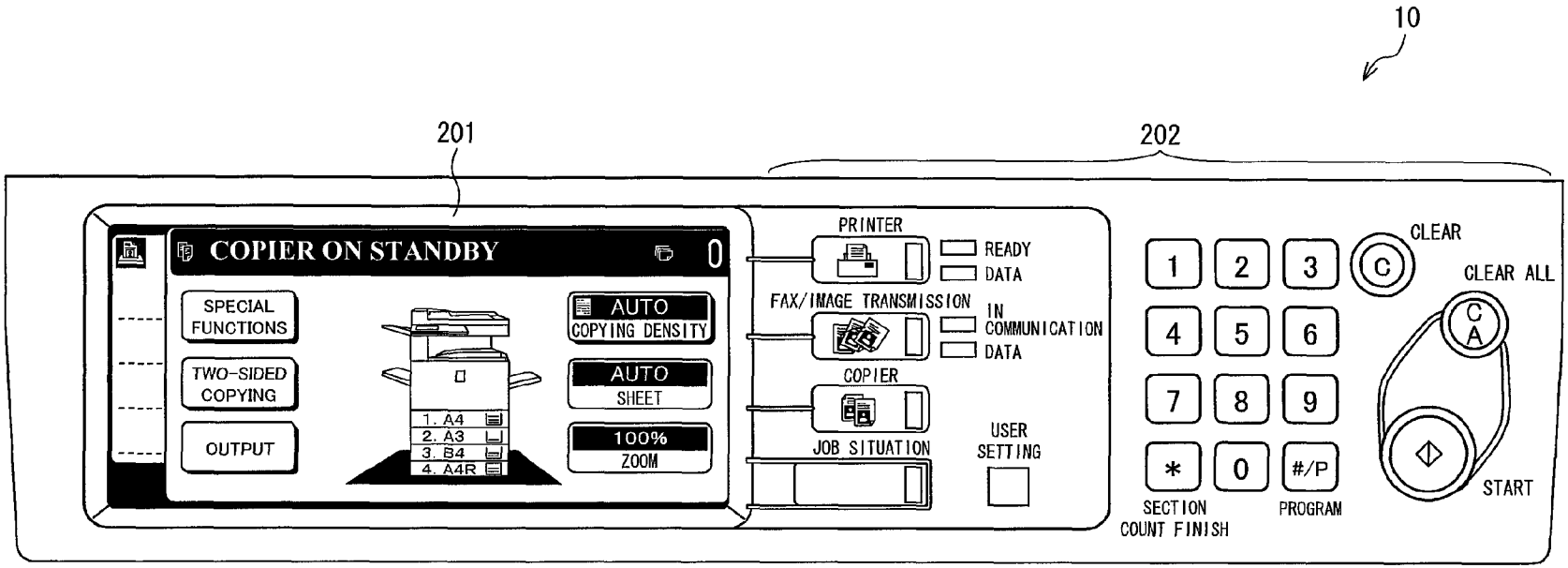
FIG. 8 is a plan view of an operation panel contained in a multifunctional apparatus of an embodiment in accordance with the present invention.

FIG. 8 is a plan view showing an example of an operation panel 10. As illustrated in FIG. 8, the operation panel 10 includes a display section 201, which is formed of a liquid crystal display, and an operation section 202, which is composed of components such as operation keys. Alternatively, the display section 201 may be a touch panel. The operation panel 10 causes the display section 201 to display information corresponding to an instruction of the control section 9, and transmits information which is entered by a user via either the operation section 202 or the display section 201 provided as a touch panel. By means of the operation panel 10, a user can enter a processing request (e.g. a processing mode (copying, printing, faxing, correcting or editing of image data or the like) and the number of sheets to be processed (the number of copies, the number of sheets to be printed, or the like)) with respect to input image data.

The control section 9 controls operation of each section contained in the multifunctional apparatus 100. Specifically, the control section 9 includes: a ROM (read only memory) which stores a control program for performing the function of controlling operation of each section contained in the multifunctional apparatus 100; a RAM (random access memory) in which the above program is loaded; a memory in which data of various kinds is stored; and a CPU (central processing unit) which executes an instruction of the control program. The control section 9 controls operation of each section contained in the multifunctional apparatus 100 in accordance with (i) an instruction entered by a user via the operation panel 10 or an input instruction supplied via the communication section 2 and (ii) the control program. Additionally, the control section 9 is not necessarily realized by use of software, and may be operated by hardware logic. Alternatively, the control section 9 may be realized by a combination of (i) hardware which performs some of the controlling process and (ii) arithmetic means for executing software for controlling the hardware and for performing remaining controlling process.

[Arrangement of the Fixing Device 6]

Figure 4:
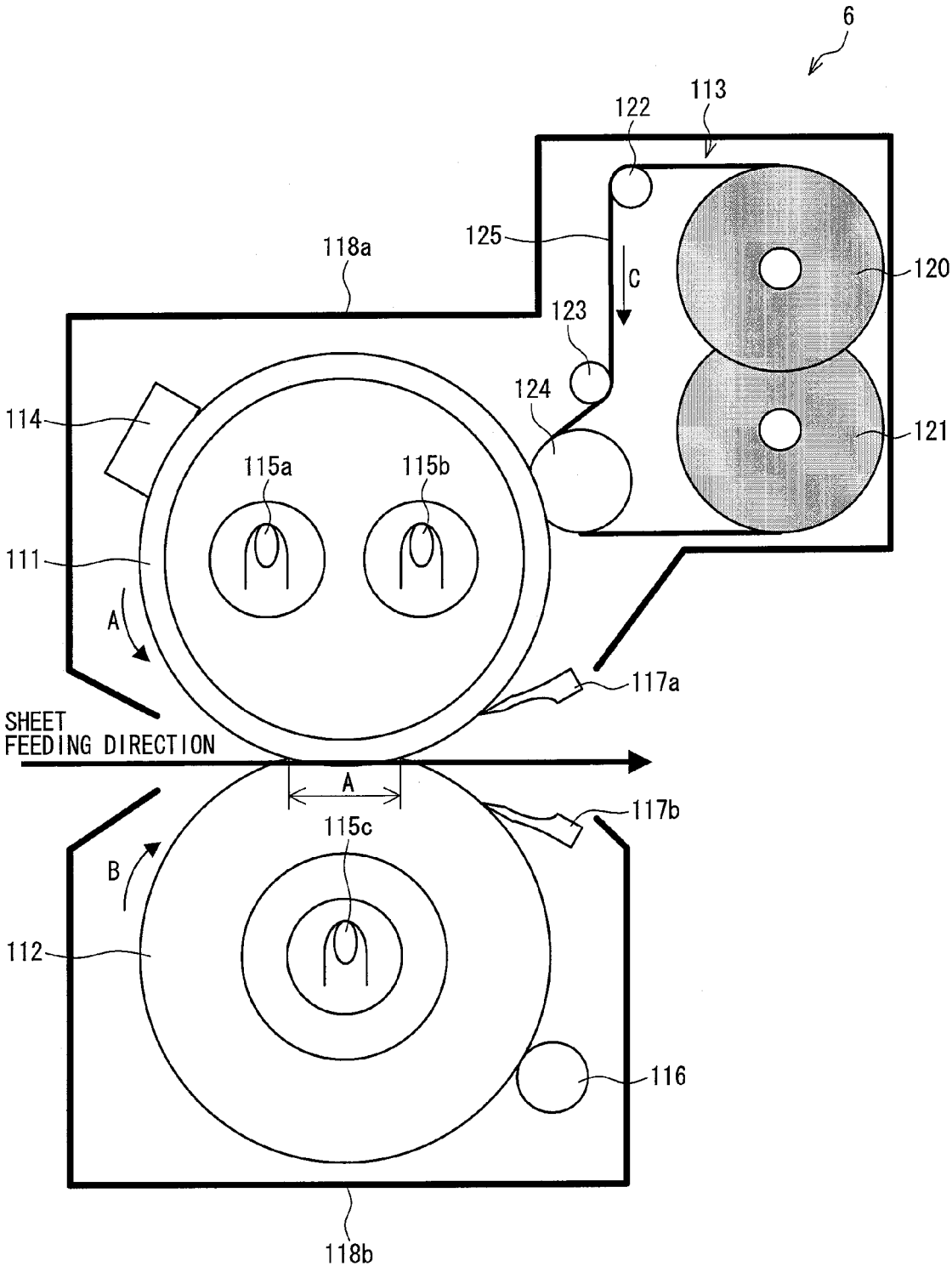
FIG. 4 is a cross-sectional view of a fixing device contained in a multifunctional apparatus of an embodiment in accordance with the present invention.

FIG. 4 is a cross-sectional view of a schematic arrangement of the fixing device 6. As illustrated in FIG. 4, the fixing device 6 includes a heat roller 111, a pressure roller 112, a cleaning unit 113, a thermistor 114, heaters 115*a* to 115*c*, a cleaning metal roller 116, paper peeling nails 117*a* and 117*b*, a heat roller cover 118*a* and a pressure roller cover 118*b*. The fixing device 6 fuses with use of heat of the heat roller 111*a* toner image transferred on a sheet. The sheet is sandwiched between the heat roller 111 and the pressure roller 112 so that the pressure caused by the two rollers allows the fused toner to penetrate a fibrous component (e.g. cellulose) of the sheet. The unfixed toner is then fixed on the sheet by means of the tacking effect on the sheet which effect is caused when the fused toner is solidified. It should be noted that the sheet is not limited to paper, and may be an OHP sheet, for instance.

The heat roller 111 rotates in a direction designated by A in FIG. 4. The heat roller 111 includes a core bar having a shape of a hollow cylinder, an elastic layer with which the outer surface of the core bar is covered, and a releasing layer with which the elastic layer is covered. The material for the core bar is not particularly limited. Therefore, aluminum, iron, stainless steel or the like can be used as the material. The material of the elastic layer is not particularly limited as well. For example, silicon rubber, which has resistance to heat, can be used. The releasing layer is preferably formed from a material which has great heat resistance and durability, and a great releasing property with respect to toner. For example, a fluorine-based material such as PFA (tetra fluoro ethylene-perfluoro alkylvinyl ether copolymer) and PTFE (polytetrafluoro-ethylene) can be used. According to the present embodiment, the heat roller 111 having a diameter of 60 mm is used.

The pressure roller 112 rotates in a direction designate by B in FIG. 4. The pressure roller 112 includes a core bar having a shape of a hollow cylinder, an elastic layer with which the outer surface of the core bar is covered, and a releasing layer with which the elastic layer is covered. The materials for the core bar, the elastic layer and the releasing layer are not particularly limited. For example, the same materials as in the heat roller 111 can be used. Further, the pressure roller 112 is pressed against the heat roller 111 by a predetermined load generated by an elastic member (e.g. a spring, not shown). As a result, a fixing nip area A (an area where the heat roller 111 makes contact with the pressure roller 112) is formed between the outer surface of the heat roller 111 and the outer surface of the pressure roller 112. Further, the pressure roller 112 rotates in a direction reverse to the direction in which the heat roller 111 rotates since the pressure roller 112 is driven by the rotation of the heat roller 111 (The surfaces of the two rollers move in the same direction in the fixing nip area). Alternatively, the pressure roller 112 may be driven rotating by rotation driving means which is different from the heat roller 111. According to the present embodiment, the pressure roller 112 having a diameter of 60 mm is used.

The thermistor 114 is disposed so as to be in contact with the outer surface of the heat roller 111. The thermistor 114 detects a temperature of the outer surface of the heat roller 111 and then sends the detection result to the control section 9. According to the present embodiment, in accordance with a surface temperature of the heat roller 111 which is detected by the thermistor 114, the control section 9 controls electric power supplied from power source means (not shown) to the heaters 115*a* and 115*b* which are provided inside the heat roller 111. This allows each of the heat roller 111 and the pressure roller 112 to keep a surface temperature to a predetermined fixing set temperature (According to the present embodiment, the surface temperature of the heat roller 111 is set to fall in a range of 170° C. to 190° C. (i.e. the toner fusing temperature +20° C. to +40° C.), and the surface temperature of the pressure roller 112 is set to fall in a range of 110° C. to 150° C.). Alternatively, it is possible to provide an additional thermistor for detecting a surface temperature of the pressure roller 112 so that, in accordance with the respective surface temperatures of the heat roller 111 and the pressure roller 112, the control section 9 controls electric power supplied to each of the heaters 115*a*, 115*b* and 115*c*, i.e. the amount of heat generated by each of the heaters.

The heaters 115*a* and 115*b* are disposed inside the core bar (i.e. in a hollow portion) of the heat roller 111. The heater 115*c* is disposed inside the core bar (i.e. in a hollow portion) of the pressure roller 112. The heaters 115*a*, 115*b* and 115*c* perform thermal radiation in accordance with electric power supplied from the power source means. As a result, the heat roller 111 and the pressure roller 112 are heated. Each arrangement of the heaters 115*a*, 115*b* and 115*c* is not particularly limited. A halogen lamp or the like can be used as the heater, for example.

The multifunctional apparatus 100 is arranged so as to form an image on each of the sheets of a plurality of kinds each having a different width in a direction perpendicular to the sheet feeding direction. The heaters 115*a* and 115*b* are disposed in accordance with a region in which the heat roller 111 abuts on each of the sheets of a plurality of kinds. Specifically, the heater 115*a* is disposed in a central portion of an axis direction of the heat roller 111, and the heater 115*b* is disposed so as to extend in the axis direction and to reach both ends of the axis of the heat roller 111. When a printing is carried out with respect to small-sized sheet, the heater 115*a* is controlled to turn on, and the heater 115*b* is controlled to turn off so that the heat amount lost in the central portion of the heat roller 111 is compensated for. On the other hand, when a printing is carried out with respect to a large-sized sheet, both the heaters 115*a* and 115*b* are controlled to turn on so that the heat amount lost in the entire surface of the heat roller 111 is compensated for. This allows the surface temperature of the heat roller 111 to be maintained in a predetermined range no matter what size of sheet to be printed.

It should be noted that the number of heaters provided inside the heat roller 111 is not limited to the above. The number of heaters may be properly determined in accordance with the kind (size, material and the like) of sheet, the toner characteristic, the processing speed (printing process speed) and the like, each being used in the multifunctional apparatus 100. In the case where a processing speed is high, it is preferable to improve heating performance of the heat roller 111 by providing a plurality of heaters or using a heater which has a high heating performance. In the case where a processing speed is low, it is possible to sufficiently heat the heat roller 111 even if the number of heaters is small (e.g. even if one heater is provided). This is because the heat amount of the heat roller 111 is small, which amount is lost via sheets and toner. On the other hand, in the case where a processing speed is high, the number of sheets passing through the fixing nip area per unit time becomes large. As a result, the heat amount of the heat roller 111 increases, which amount is lost via sheets and toner. Therefore, it is preferable to improve performance of heating the heat roller 111, by, for example, providing a plurality of heat sources inside the heat roller.

The paper peeling nails 117*a* and 117*b* are disposed so that their leading ends, (i) make contact with and (ii) are inclined at predetermined angles with respect to, the surfaces of the heat roller 111 and the pressure roller 112, respectively. The paper peeling nails 117*a* and 117*b* peel off, from the heat roller 111 and the pressure roller 112, respectively, a sheet which passed through the fixing nip area. It should be noted that the paper peeling nails 117*a* and 117*b* are not essential elements to the present embodiment. Namely, it is possible to omit the paper peeling nails 117*a* and 117*b* so that a sheet peels off by itself from the heat roller 111 and the pressure roller 112.

The cleaning unit 113 removes dirt such as toner adherent to the surface of the heat roller 111. As illustrated in FIG. 4, the cleaning unit 113 includes a web sheet unwinding roller 120, a web sheet winding roller 121, tension rollers 122 and 123, a pressure roller 124 and a web sheet 125. The web sheet 125 causes the web sheet unwinding roller 120, the tension rollers 122 and 123, the pressure roller 124 and the web sheet winding roller 121 to be engaged with each other. Further, the web sheet 125 is pressed by the pressure roller 124 against the heat roller 111, thereby pressing the heat roller 111 at a predetermined force. The web sheet winding roller 121 is driven and rotated by driving means (not shown). This causes the web sheet 125 wound around the web sheet unwinding roller 120 is wound by the web sheet winding roller 121, via the tension rollers 122, 123 and the pressure roller 124.

The cleaning metal roller 116 is disposed so as to abut on the outer surface of the pressure roller 112, thereby removing dirt such as toner adherent to the outer surface of the pressure roller 112.

The heat roller cover 118*a* is provided so as to cover the heat roller 111, the thermistor 114 and the cleaning unit 113. The pressure roller cover 118*b* is provided so as to cover the pressure roller 112 and the cleaning metal roller 116.

According to the present embodiment, the heater 115*c* is provided inside the pressure roller 112. However, the present embodiment is not limited to this. For example, it is possible that the pressure roller 112 does not have heating means.

However, it should be noted that the degree of the tacking effect that fused toner has on a sheet differs depending on the temperature of the sheet. Specifically, the higher the temperature of the sheet, the deeper in the sheet fused toner penetrates (i.e. the longer the penetration distance in the sheet). Consequently, the adhesiveness of toner to the sheet increases, and the fixing performance therefore improves. In cases where an image forming apparatus has a low processing speed during continuous printing, a time interval during feeding of sheets is long. This causes a sufficient heat amount to be transferred from the heat roller to the pressure roller via the fixing nip area, so that the pressure roller is heated. Therefore, the pressure roller does not require any heat source. However, in cases where an image forming apparatus has a high processing speed, a time interval during feeding of sheets becomes short. Consequently, the heat amount transferred from the heat roller to the pressure roller via the fixing nip area becomes insufficient. Specifically, the surface temperature in the fixing nip area of the heat roller 111 falls in a range of 160° C. to 200° C., whereas the surface temperature of a sheet fed to the fixing nip area is equal to the temperature inside the apparatus (i.e. approximately in a range of 15° C. to 35° C.). Thus, there is a large difference in temperature in the fixing nip area between the surface of the heat roller 111 and the surface of a fed sheet. Because of this, when penetrating in the cellulose of a sheet due to the tacking effect, fused toner is cooled rapidly. This causes the tacking effect to be reduced. In order to avoid such an undesirable influence, in cases where an image forming apparatus has a high processing speed, a heat source is preferably provided inside or outside the pressure roller. In this case, the pressure roller is heated up to an appropriate temperature so that the sheet is heated from a surface reverse to a surface on which an image is formed (a surface on which unfixed toner is formed), thereby enhancing the tacking effect. According to the present embodiment, the processing speed is set to a high speed of 600 mm/s (600 mm/s is equal to a speed at which an image can be formed on 100 A4 sheets per minute). As illustrated in FIG. 4, the heater 115*c* is provided inside the pressure roller 112. As a result, a sheet is heated in the fixing nip area by the heat of the pressure roller, and so the tacking effect of a toner image on the sheet can be improved.

[Image Forming Process of the Multifunctional Apparatus 100]

Figure 1:
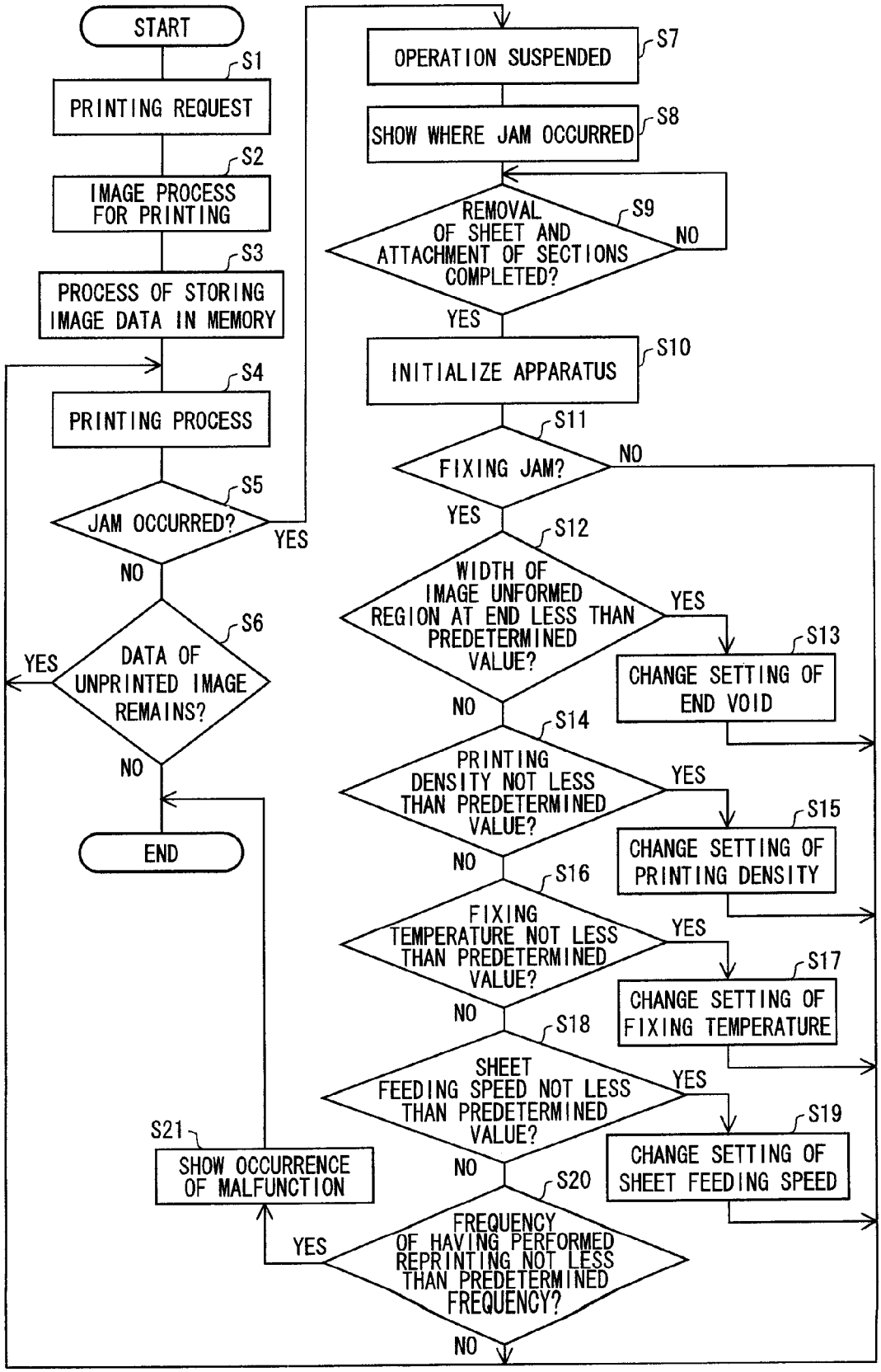
FIG. 1 is a flow chart showing a process performed when a JAM occurs in a multifunctional apparatus of an embodiment in accordance with the present invention.

The following description deals with an image forming process of the multifunctional apparatus 100. FIG. 1 is a flow chart showing a process of the multifunctional apparatus 100.

As illustrated in FIG. 1, when a printing instruction is entered by a user (S1), the control section 9 causes the image processing section 3 to perform an image process for outputting of printing with respect to inputted image data (S2). Further, the control section 9 temporarily stores in the memory 4 the image data that has been subjected to image process (S3). In the case of a printer mode or a fax mode, a printing instruction and image data are entered from a terminal unit (e.g. a personal computer) in a network. In the case of a copier mode, a printing instruction is entered by a user via the operation panel 10, and an image on a sheet is then scanned by the scanner section 1, so that image data is acquired.

Subsequently, the control section 9 controls each of the sections (the laser printer section 5, the fixing device 6, the paper feeding section 7, the sheet feeding mechanism 8 and the like) of the multifunctional apparatus 100 so that an image, corresponding to the image data that was stored in the memory 4 in S3, is printed onto a sheet (S4). In cases where the printing process is performed with respect to a plurality of sheets, it will be also possible to simultaneously perform (i) an printing process with respect to the nth sheet (where n is an integer of one or more) and (ii) an image process with respect to image data to be printed on sheets which follow the nth sheet.

In cases where a printing process is the first printing process (i.e. a process is not a reprinting process which is performed after an occurrence of JAM), the control section 9 sets to initial setting values, respectively, a leading end void, a printing density, a fixing temperature (i.e. a surface temperature of the heat roller 111) and a processing speed. The leading end void indicates a width, in the sheet feeding direction, of a margin of a sheet which is located upstream in the sheet feeding direction (A margin indicates an area where an image corresponding to image data is not formed). According to the present embodiment, the initial setting value of the leading end void is set to 2 mm, the initial setting value of the fixing temperature is set to 180° C., and the initial setting value of the processing speed is set to 600 mm/s. As regards the printing density, the initial setting values, such as a charged electric potential and a developing bias (a voltage applied between the photosensitive drum 101 and the development device 103 during developing process), of the photosensitive drum 101, are set so that an image which has a printing density corresponding to the image data can be properly formed on a sheet.

During the printing process, the control section 9 determines whether or not a JAM has occurred (S5). Specifically, the control section 9 determines whether or not a sheet is being fed normally, in accordance with the sheet detection results from a plurality of sheet sensors (not shown), which are provided in the paper feeding section 7 and the sheet feeding mechanism 8. This allows a determination as to whether or not a JAM has occurred.

In cases where it is determined in S5 that a JAM has not occurred, the control section 9 determines whether or not there remains data that has not been subjected to printing process (S6). When it is determined that there remains such image data, the process including S4 and the following steps is performed with respect to the data that has not been subjected to printing process. When it is determined that there remains no image data that has not been subjected to printing process, the process is terminated.

Figure 9:
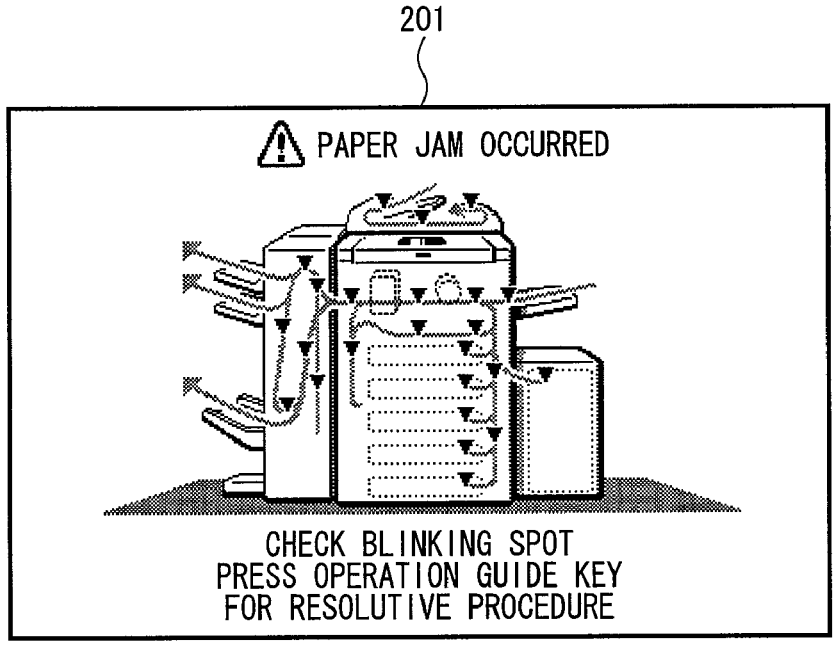
FIG. 9 is a plan view of an exemplary display which is shown, when a JAM occurs, on a display section of the operation panel in FIG. 8.

On the other hand, in cases where it is determined in S5 that a JAM has occurred, the control section 9 suspends the printing operation of the image forming apparatus 100 (S7), and controls the display section 201 of the operation panel 10 so that an image indicative of where the JAM has occurred, where a sheet stays and the like (S8). FIG. 9 is an explanatory diagram showing an exemplary display which is shown on the display section 201 when a JAM has occurred. According to the example illustrated in FIG. 9, a location where the sheet stays is designated by the ▲ mark. The display further indicates that it is possible to show a resolutive procedure (i.e. a procedure for removing a remaining sheet) by pressing a predetermined key. A user refers to the display and then removes the sheet that caused the JAM and a sheet that remains in the apparatus.

Subsequently, the control section 9 determines (i) whether or not all of the sheet that caused the JAM and the sheet that stays in the apparatus have been removed, and (ii) whether or not the attachment of each of the sections (each provided in the multifunctional apparatus 100 and an exterior lid of the multifunctional apparatus 100) is completed (S9). In the multifunctional apparatus 100, sensors such as on/off switches (not shown) are provided so as to detect whether or not a section which can be removed, moved, or rotated and the exterior lid are normally attached. The control section 9 determines whether or not each of the sections is attached in accordance with the detection results from the sensors. As described above, the control section 9 determines whether or not the sheet that has stayed in the apparatus was removed in accordance with the detection result from each sheet sensor. In cases where removal of the sheet and each attachment of the sections is not completed, the control section 9 continues to monitor the removal and the attachment until completion.

In cases where the control section 9 determines in S9 that the removal of the sheet and the attachment of the sections are completed, the control section 9 initializes the multifunctional apparatus 100 (S10). Note that, in the case of a reprinting made after a fixing JAM, and in the case where setting values are changed during the previous reprinting, the setting values thus changed are used. Thereafter, the control section 9 determines whether or not a JAM has occurred in the fixing device 6, i.e. whether or not a fixing JAM has occurred (S11). In cases where it is determined in S11 that no fixing JAM has occurred, the process including S4 and the following steps is performed again with respect to the image data which was stored in the memory 4 in S3.

In the case where it is determined in S11 that a fixing JAM has occurred, the control section 9 determines whether or not, in the sheet that caused such a fixing JAM, an image unformed region (a region onto which toner has not been transferred) of an end part has a width of less than a predetermined value (4 mm in the present embodiment) in the sheet feeding direction, which end part is situated upstream in the sheet feeding direction (S12).

In cases where it is determined in S12 that the width is less than the predetermined value, the control section 9 changes the setting value of the leading end void (S13) so that a printing process (a reprinting process) including S4 and the following steps is performed in accordance with the setting value thus changed. In this embodiment, the setting value of the leading end void is changed from the initial setting value of 2 mm to 4 mm. When the reprinting process is successfully performed, the setting value of the leading end void is set back to the initial setting when forming all image data that follow. This makes it possible, without deteriorating image quality, to form an image corresponding to image data other than the image data to which a reprinting is performed. Alternatively, it will be also possible to perform a printing, in accordance with the setting value thus changed, with respect to a job which includes the image data that has caused a JAM.

The control section 9 controls the timing at which the idle roller 132 sends out a sheet, in accordance with the set value of the end void, so that the leading end void is changed. On this account, it will be also possible to (i) use the image data without changing which was stored in the memory 4 in S3 after the image process is performed in S2 and (ii) change the setting value of a leading end void so that the above width is changed. As a result, it is possible to simplify the process and to shorten the processing time for a reprinting process, in comparison with a case in which the width is changed by an image process such as a parallel shift, enlargement/reduction, a rotation and the like). Alternatively, it will be also possible, for example, to change the width by performing an image process in the image processing section 3 with respect to the image data stored in the memory 4.

In cases where it is determined in S12 that the above width is not less than the predetermined value, the control section 9 determines whether or not a maximum value or an average value of the printing density is a predetermined value or more in a region (a region within 30 mm or less from a leading end of the sheet, according to the present embodiment) falling within a predetermined range from an end part of a sheet that has caused a JAM which end part is located upstream in the sheet feeding direction (S14). The present embodiment is not limited to this. For example, it will be also possible for the control section 9 to determine whether or not a small region, in which pixels having a printing density of not less than a predetermined value are combined with each other, cover a space of not less than a predetermined area.

In cases where it is determined that the printing density is not less than the predetermined value, the control section 9 changes the setting of the printing density (S15) so that the printing process (the reprinting process) including S4 and the following steps is performed in accordance with the setting value thus changed. In cases where the setting value of the printing density is changed, subsequent printing relating to the job is performed in accordance with the setting value of the printing density thus changed. This eliminates frequent changes in the printing density and so it is possible to simplify the process required for controlling the printing density and to shorten the processing time required for controlling the printing density. This allows image forming to be performed rapidly. The present embodiment is not limited to this. Alternatively, in cases where a reprinting process is successfully performed, it will be also possible to set the printing density back to the initial setting value at a time of a subsequent image formation.

The control section 9 changes the printing density in the reprinting process, by changing at least one of a charged electric potential of the photosensitive drum 101 and a developing bias voltage. This makes it possible to (i) use, without changing, the image data which was stored in the memory 4 in S3 after the image process is performed in S2 and (ii) change a printing density with respect to a sheet. As such, it is possible to simplify the process and to shorten the processing time for reprinting, in comparison with cases in which the printing density is changed by an image process (printing density correction and the like). Alternatively, it will be also possible, for example, to change a printing density by performing an image process in the image processing section 3 with respect to the image data stored in the memory 4.

In cases where it is determined in S14 that the printing density is less than the predetermined value, the control section 9 determines whether or not the fixing temperature at the time when the JAM has occurred is not less than a predetermined value (170° C. or more, according to the present embodiment) (S16). Alternatively, it will be also possible to determine whether or not a setting value of the fixing temperature at the time when the JAM has occurred stood is not less than a predetermined value. In this case, it will be possible to determine it based on a stored temperature which was detected by the thermistor 114 at the time when the JAM has occurred.

In cases where it is determined that the fixing temperature is the predetermined value or more, the control section 9 changes the setting value of the fixing temperature (S17) so that the printing process (the reprinting process) including S4 and the following steps is performed in accordance with the setting value thus changed. In this embodiment, the setting value of the fixing temperature is changed from the initial setting value of 180° C. into 170° C. The setting value of the fixing temperature is not limited to this. However, it is necessary that the setting value be set to a temperature which falls within a range in which a proper fixing process can be performed (e.g. within a range in which no fault such as a cold offset and a hot offset occurs). Note that the control section 9 controls a fixing temperature by controlling electric power supplied from the power source means to each of the heaters in the fixing device 6. Note also that, in cases where the setting value of the fixing temperature is changed, subsequent printing relating to the job is performed in accordance with the setting value of the fixing temperature thus changed. This eliminates frequent changes in the fixing temperature and so it is possible to simplify the process required for controlling the fixing temperature and to shorten the processing time required for controlling the printing density. This allows image forming to be performed rapidly. The present embodiment is not limited to this. Alternatively, in cases where a reprinting process is successfully performed, it will be also possible to set the fixing temperature back to the initial setting value at a time of a subsequent image formation.

In cases where it is determined in S16 that the fixing temperature is less than the predetermined value, the control section 9 determines whether or not the processing speed is not less than a predetermined value at the time when the JAM has occurred (S18).

In cases where it is determined that the processing speed is not less than the predetermined value, the control section 9 changes the processing speed to a lower speed than at the time when the JAM has occurred (S19). The control section 9 controls each of the sections of the multifunctional apparatus 100 in accordance with the setting value thus changed so that the printing process (the reprinting process) including S4 and the following steps are performed. In cases where the setting value of the processing speed is changed, subsequent printing relating to the job is performed in accordance with the processing speed thus changed. This eliminates frequent changes in the processing speed and so it is possible to simplify the process required for controlling the processing speed and to shorten the processing time required for controlling the processing speed. This allows image forming to be performed rapidly. The present embodiment is not limited to this. Alternatively, in cases where a reprinting process is successfully performed, it will be also possible to set the processing speed back to the initial setting value at a time of a subsequent image formation.

Figure 10:
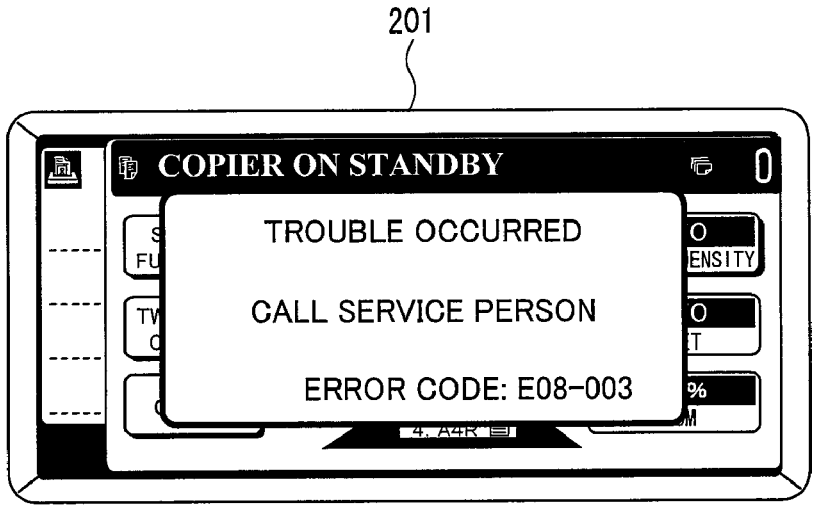
FIG. 10 is a plan view of an exemplary display which is shown, when failure occurs in the apparatus, on the display section of the operation panel in FIG. 8.

In cases where it is determined in S18 that the processing speed is less than the predetermined value, the control section 9 determines whether or not the frequency of having performed reprinting is a predetermined frequency (five times, according to the present embodiment) or more (S20). In cases where the frequency of having performed reprinting is less than the predetermined frequency, S4 is proceeded and another reprinting process is performed. In cases where it is determined in S20 that the frequency of having performed reprinting is not less than the predetermined frequency, the control section 9 determines that the JAM is not caused by the image forming conditions but caused by malfunction of the apparatus. The control section 9 causes the display section 201 of the operation panel 10 to display the malfunction of the apparatus (S21), and terminates the process. FIG. 10 is an explanatory diagram showing an exemplary display on the display section 201 at a time when the control section 9 determines that malfunction of the apparatus has occurred. In the example illustrated in FIG. 10, the display indicates that (i) some malfunction of the apparatus has occurred, (ii) the malfunction of the apparatus needs to be cleared by a service person, and (iii) an error code indicative of what the malfunction is. In cases where it is determined that the malfunction of the apparatus has occurred, it will be possible that the control section 9 causes a trouble history to be stored in a non-volatile memory and controls to prevent image forming operation from being started even if the multifunctional apparatus 100 is turned off and then restarted, as long as the process of clearing the trouble is not completed. This makes it possible to prevent image forming operation from being repeated while the malfunction of the apparatus has occurred. As a result, it is possible to prevent the extent or the area of the malfunction from expanding and to prevent consumables and electric power consumption from being wasted.

As described above, in the case of a reprinting of the image formed on a sheet that has caused a JAM after a JAM occurred in the fixing device 6, a multifunctional apparatus 100 of the present embodiment changes into an image forming condition that is different from that under which the JAM has occurred, and then performs a reprinting. This allows a reduction in the possibility that a JAM recurs in the fixing device 6 during a reprinting process. This can contribute to an improvement in efficiency of the printing process, a reduction in waste of printing sheets, a reduction in running costs, and a longer life of the fixing device resulting from a reduction in loads on the fixing device.

According to the present embodiment, priorities are set for the content of changes in image forming conditions during reprinting process so that at least one image forming condition is changed into another in accordance with the priorities each time a JAM occurs. This can (i) reduce the possibility that a JAM recurs during reprinting process and (ii) minimize a deterioration of image quality.

The inventors of the present invention found that the following factors (1) to (4) largely affect the occurrence of a JAM, as a result of their devotion to the research into the reasons why a JAM occurs in the fixing device. According to the present embodiment, each one of the image forming conditions is changed every time a fixing JAM occurs, and then a reprinting process is performed.

(1) The width of a margin in the leading end of a sheet (the width, in the sheet feeding direction, of a margin of a leading end of a sheet). Because the leading end of a sheet has strong adhesiveness to the heat roller when the width is narrow, it becomes hard for the sheet to peel off from the heat roller (even in an arrangement including a paper peeling nail, it becomes hard for the sheet to peel off properly from the heat roller).

(2) The printing density of an image in a leading end of a sheet. Because a leading end of a sheet has strong adhesiveness to the heat roller when the printing density is large in a leading end of the sheet, it becomes hard for the sheet to peel off from the heat roller.

(3) The fixing temperature, i.e. a surface temperature of the heat roller during fixing process. Because the toner has strong adhesiveness to the surface of the heat roller when the surface temperature of the heat roller is high, it becomes hard for the sheet to peel off from the heat roller.

(4) The processing speed. In cases where a processing speed is high, even a slight delay in the timing at which a sheet peels off from the heat roller increases the likelihood of an occurrence of JAM.

According to the present embodiment, the order of priorities for changing image forming conditions is set to the order from the factors (1) to (4). However, the order of priorities is not limited to this order, and may be set properly in consideration of (i) the degree of effect of decreasing the possibility that a JAM recurs and (ii) the degree of effect of suppressing deterioration in image quality. For example, in cases where deterioration in image quality needs to be reduced as much as possible, the order of priorities may be set to (2), (4), (3) and (1) in this order.

Factors for changing image forming conditions are not limited to the factors (1) to (4). In addition to the conditions (1) to (4), or in place of one or more of the conditions (1) to (4), other factors, which affect the occurrence of a JAM, may be used for changing image forming conditions.

According to the present embodiment, in cases where a JAM has occurred, out of the image forming conditions in the factors (1) to (4), only a corresponding image forming condition(s) is (are) changed. For example, in cases where the width of a region, of the leading end of a sheet, where no image is formed is less than a predetermined value, the image forming condition in the factor (1) is changed, whereas in cases where the width of a region, of the leading end of a sheet, where no image is formed is not less than the predetermined value, the image forming condition in the factor (1) is not changed. In cases where the printing density is a predetermined value or more, the image forming condition in the factor (2) is changed, whereas in cases where the printing density is less than the predetermined value, the image forming condition in the factor (2) is not changed. In cases where the fixing temperature is a predetermined value or more, the image forming condition in the factor (3) is changed, whereas in cases where the fixing temperature is less than the predetermined value, the image forming condition in the factor (3) is not changed. In cases where the processing speed is a predetermined value or more, the image forming condition in the factor (4) is changed, whereas in cases where the processing speed is less than the predetermined value, the image forming condition in the factor (4) is not changed.

Consequently, the image forming conditions that may have affected the occurrence of a JAM are chosen from among the image forming conditions used at the time when the JAM occurred, and such image forming conditions thus chosen can be sequentially changed in accordance with the order or priorities. Therefore, it is possible to more efficiently reduce the possibility that a JAM recurs during a reprinting process.

The present embodiment is not limited to this. It will be also possible to sequentially change, for every reprinting process, an image forming condition in accordance with a predetermined order of priorities, irrespective of the image forming conditions used at the time when a JAM has occurred. In this case, since it is not necessary to choose an image forming condition that may have affected a JAM, the process can be simplified.

Figure 5:
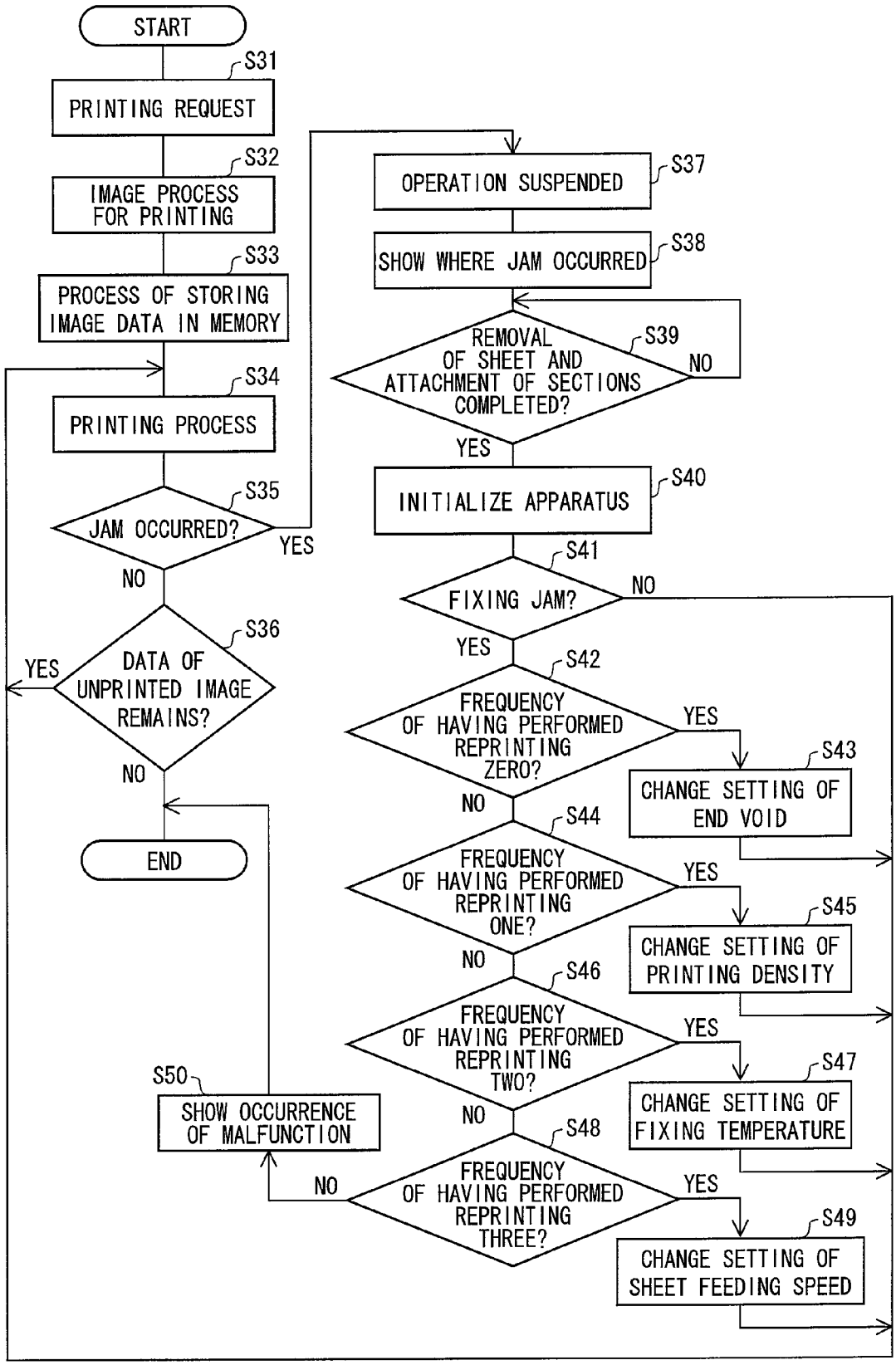
FIG. 5 is a flow chart showing a modified process performed when a JAM occurs in a multifunctional apparatus of an embodiment in accordance with the present invention.
Figure 6:
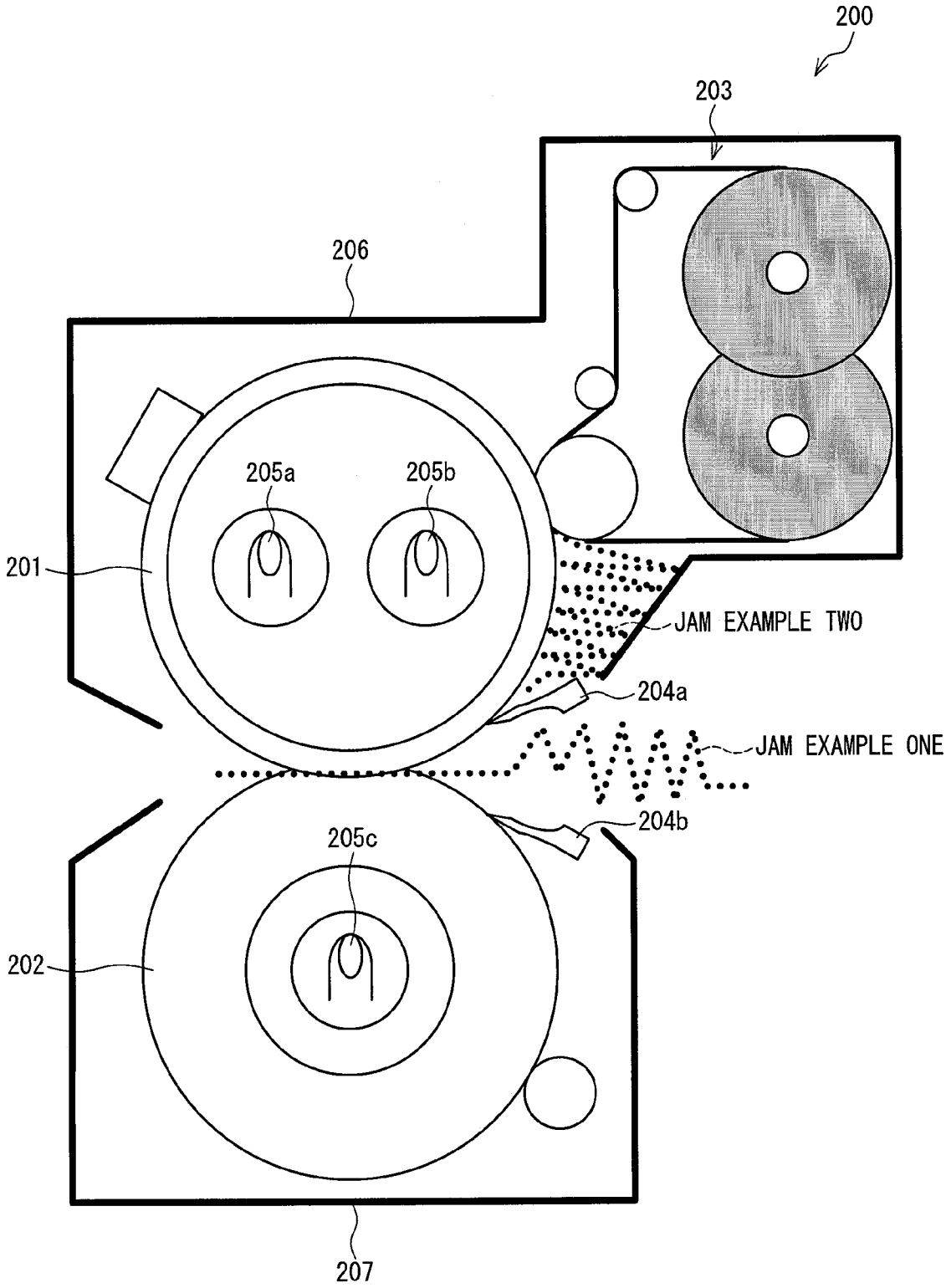
FIG. 6 is an explanatory diagram explaining an example of a fixing JAM which occurs in a conventional image forming apparatus.
Figure 7:
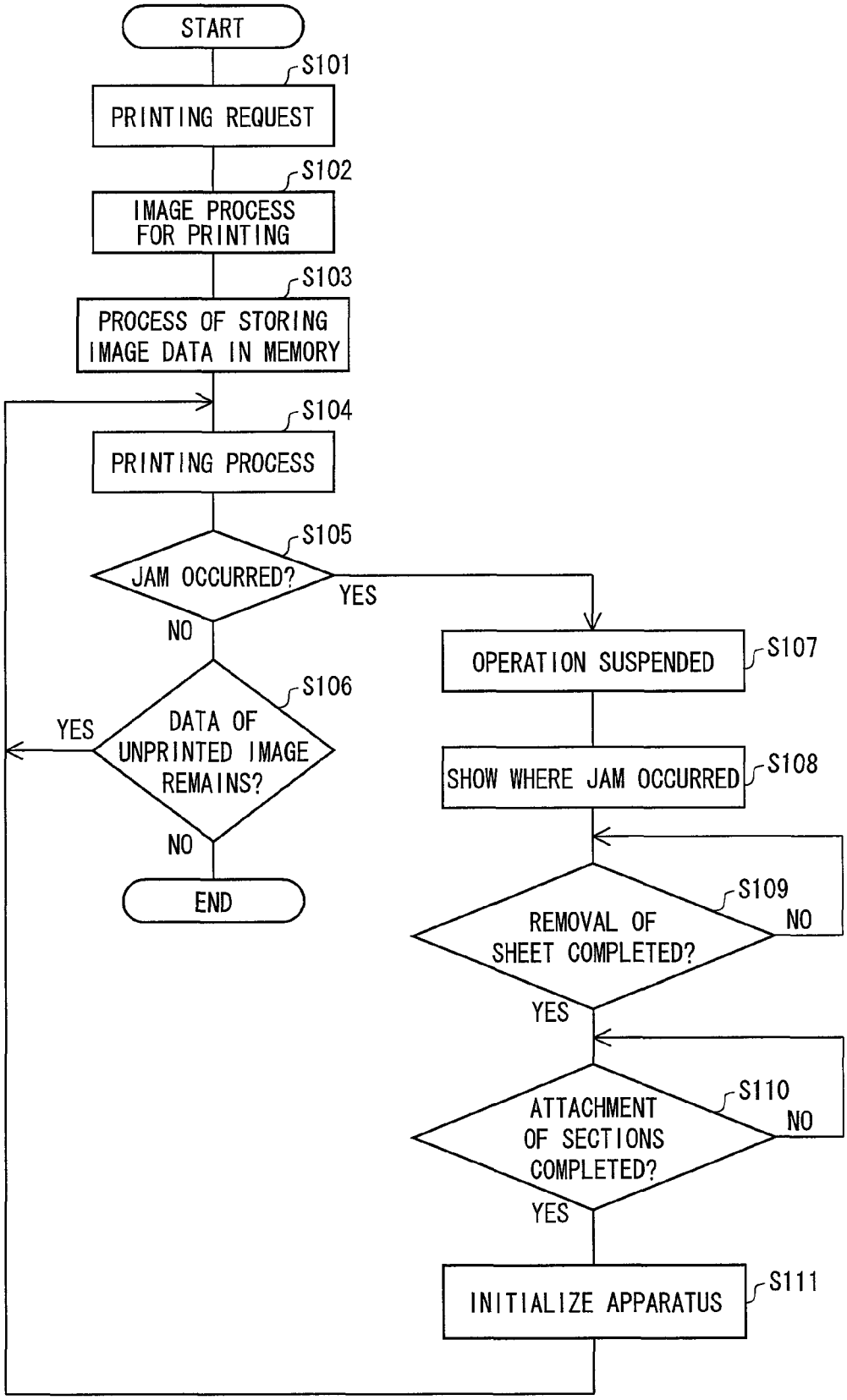
FIG. 7 is a flow chart showing a process performed when a JAM occurs in a conventional image forming apparatus.

FIG. 5 is a flow chart showing a process in which an image forming condition is sequentially changed, for every reprinting process, in accordance with a predetermined order of priorities, irrespective of the image forming conditions used at the time when a JAM has occurred. The process designated by S31 through S40 in FIG. 5, which process corresponds to the process designated by S1 through S10 in FIG. 1, is not explained further here.

After initializing the multifunctional apparatus 100 in S40, the control section 9 determines whether or not a fixing JAM has occurred, i.e., whether or not a JAM has occurred in the fixing device 6 (S41). In cases where it is determined that the JAM is not a fixing JAM, S34 is proceeded so that a reprinting process is performed.

In cases where it is determined that the JAM is a fixing JAM, the control section 9 determines whether or not the frequency of having performed reprinting with respect to the image that was formed on the sheet that caused the JAM is zero, i.e., whether or not the reprinting process to be performed next is the first one (S42). The control section 9 counts the frequency of having performed reprinting with respect to the same image, and causes the memory 4 to store the frequency thus counted. The control section 9 determines the frequency of having performed reprinting in accordance with the frequency thus counted and stored. In cases where a reprinting process is performed with normal outputting without causing a JAM, the count is reset.

In cases where it is determined in S42 that the frequency of having performed reprinting is zero, the control section 9 changes the setting value of the leading end void (S43) so that the printing process (the reprinting process) including S34 and the following steps is performed in accordance with the setting value thus changed. In accordance with the set value of the end void, the control section 9 changes a leading end void by controlling the timing at which the idle roller 132 sends out a sheet.

In cases where it is determined in S42 that the frequency of having performed reprinting is not zero, the control section 9 determines whether or not the frequency of having performed reprinting is one, i.e. whether or not the reprinting process to be performed next is the second one (S44). In cases where it is determined that the frequency of having performed reprinting is one, the control section 9 changes the setting value of the printing density (S45) so that the printing process (the reprinting process) including S34 and the following steps is performed in accordance with the setting value thus changed. The control section 9 changes the printing density used during reprinting process, by changing at least one of the charged electric potential of the photosensitive drum 101 and the developing bias voltage.

In cases where it is determined in S44 that the frequency of having performed reprinting is not one, the control section 9 determines whether or not the frequency of having performed reprinting is two, i.e., whether or not the reprinting process is the third one (S46). In cases where it is determined that the frequency of having performed reprinting is two, the control section 9 changes the setting value of the fixing temperature (S47) so that the printing process (the reprinting process) including S34 and the following steps is performed in accordance with the setting value thus changed.

In cases where it is determined in S46 that the frequency of having performed reprinting is not two, the control section 9 determines whether or not the frequency of having performed reprinting is three, i.e., whether or not the reprinting process is the fourth one (S48). In cases where it is determined that the frequency of having performed reprinting is three, the control section 9 changes the processing speed to a lower speed than at the time when the JAM has occurred (S49). The control section 9 controls each of the sections of the multifunctional apparatus 100 in accordance with the setting value thus changed so that the printing process (the reprinting process) including S34 and the following steps is performed.

In cases where it is determined in S48 that the frequency of having performed reprinting is not three, the control section 9 determines that the JAM was not caused by the image forming conditions but caused by malfunction of the apparatus. The control section 9 causes the display section 201 of the operation panel 10 to display the malfunction of the apparatus (S50) and terminates the process.

According to the present embodiment, image forming conditions are changed not by performing an image process, but by changing processing conditions such as operation timing of each section of the multifunctional apparatus 100 and/or electric power. As a result, it is not necessary to perform an image process with respect to the image data stored in the memory 4. This allows the reprinting process to be simplified, and allows the time needed to perform reprinting process to be shortened.

According to the present embodiment, the control section 9 is realized by software with use of a processor such as a CPU. Specifically, the control section 9 includes a CPU (central processing unit) which executes instructions of a control program which achieves the functions of controlling operation of each of the sections in the multifunctional apparatus 100, a ROM (read only memory) which stores the above program, a RAM (random access memory) onto which the program is loaded, a storage device (a recording medium) such as a memory in which the program and data of various kinds are stored, and the like. The object of the invention is achieved by (i) supplying to the multifunctional apparatus 100 a recording medium which stores computer-readable program codes (an executable program, an intermediate code program and a source program) of the control program for the multifunctional apparatus 100, which control program is software for realizing the functions, and (ii) by causing a computer (or a CPU or an MPU) in the multifunctional apparatus 100 to read out and execute the program codes stored in the recording medium.

As the recording medium, for example, (i) a tape such as a magnetic tape or a cassette tape, (ii) a disc including a magnetic disc such as a floppy (registered trademark) disc or a hard disc, and an optical disc such as a CD-ROM, an MO, an MD, a DVD or a CD-R, (iii) a card such as an IC card (including a memory card) or an optical card, or (iv) a semiconductor memory such as a masked ROM, an EPROM, an EEPROM or a flash ROM.

Further, the multifunctional apparatus 100 may be arranged so as to be able to be connected with a communication network, so that the program code can thereby be provided via the communication network. The communication network is not particularly limited, and can be the Internet, an intranet, an extranet, a LAN, an ISDN, a VAN, a CATV communication network, a virtual private network, a telephone network, a mobile communication network, or a satellite communication network, for example. In addition, the transmission medium of the communication network is not particularly limited. Therefore, cable communication with use of an IEEE1394, a USB, a power line carrier, a cable TV line, a telephone line or an ADSL, for example, is possible. Further, radio communication with use of an infrared radiation of the IrDA standard or of a remote control, a Bluetooth (registered trademark), an 802.11 wireless network, an HDR, a mobile phone network, a satellite connection or a digital terrestrial network, for example, is possible. The present invention can be achieved by use of a computer data signal embodied in a carrier wave which signal is formed by electronic transmission of the program code.

Additionally, the control section 9 is not necessarily realized by use of software, and may be operated by hardware logic. Alternatively, the control section 9 may be realized by a combination of (i) hardware which performs some of the controlling process and (ii) arithmetic means for executing software for controlling the hardware and for performing remaining controlling process.

As described above, an image forming apparatus of the present invention for forming on a recording material an image corresponding to image data, the image forming apparatus including: feeding means for feeding a recording material; image forming means for forming a toner image corresponding to image data, and for transferring the toner image onto the recording material; and fixing means for fixing on the recording material the toner image that was transferred by the image forming means, the image forming apparatus, further including: control means, when a feeding error of a recording material occurs in the fixing means and then an image corresponding to image data which was formed on the recording material which caused the feeding error of the recording material is re-formed on another recording material, for causing at least one of operation conditions under which said each means works when an image is formed to be different from an operation condition used when the feeding error has occurred.

Further, an image forming method of the present invention for forming on a recording material an image corresponding to image data by use of an image forming apparatus, the image forming apparatus including: feeding means for feeding a recording material; image forming means for forming a toner image corresponding to image data, and for transferring the toner image onto the recording material; and fixing means for fixing on the recording material the toner image that was transferred by the image forming means on the recording material, which image was transferred onto the recording material, the image forming method including the step of: when a feeding error of a recording material occurs in the fixing means and then an image corresponding to image data which was formed on the recording material which caused the feeding error of the recording material is re-formed on another recording material, causing at least one of operation conditions under which said each means works when an image is formed to be different from an operation condition used when the feeding error has occurred.

According to the image forming apparatus and the image forming method, after a feeding error of recording material occurs in the fixing means, the image corresponding to the image data concerned when the feeding error occurred is formed again on the recording material. In this case, at least one of the operational conditions of forming an image in the above means is set so that such a condition is different from the condition applied when the feeding error occurred. As described above, by forming the same image again in operational conditions different from the conditions under which the feeding error occurred, the possibility of a feeding error recurring in the fixing means can be lowered. Such lowered possibility of a feeding error recurring can contribute to improved efficiency in the image forming process, reduced waste of recording material, toner and power consumption, reduced running costs, and a longer life of the fixing device resulting from reduced loads.

The operation condition caused to be different by the control means when the image is re-formed is preferably an operation condition which affects a peeling characteristic of the recording material with respect to the fixing means. By causing the condition that affects the peeling characteristic of the recording material with respect to the fixing means to be different from an operation condition used when the feeding error has occurred, the possibility that a feeding error recurs in the fixing means can be reduced effectively.

Further, the condition to be modified the operation condition caused to be different by the control means when the image is re-formed may be an operation condition for changing a width, extending in a recording material feeding direction, of a region on which no image is formed in an end part of the recording material upstream in the recording material feeding direction.

According to the above arrangement, by changing a width, extending in a recording material feeding direction, of a region on which no image is formed in an end part of the recording material upstream in the recording material feeding direction, a peeling characteristic of the recording material with respect to the fixing means can be improved, and the possibility that a feeding error occurs in the fixing means can thereby be reduced.

Still further, the feeding means may include timing controlling means for sending out the recording material at a predetermined timing to a transfer position where a toner image is transferred, and the operation condition caused to be different by the control means when the image is re-formed is timing at which the recording material is sent out from the timing controlling means to the transfer position.

According to the above arrangement, the width can easily be changed. Also, it is possible to simplify the process and thereby to shorten the processing time in comparison, for example, with the arrangement in which the width is changed by performing an image process on the image data.

Furthermore, the operation condition caused to be different by the control means when the image is re-formed may be an operation condition for changing a printing density of the toner image to be transferred onto recording material.

According to the above arrangement, by changing a printing density of the toner image to be transferred onto recording material, a peeling characteristic of the recording material with respect to the fixing means can be improved, and the possibility that a feeding error occurs in the fixing means can thereby be reduced.

Further, the image forming means may include: an image bearing body; charging means for charging the image bearing body; latent image forming means for forming an electrostatic latent image corresponding to the image data on the image bearing body charged by the charging means; developing means for developing by use of toner the electrostatic latent image formed on the image bearing body so as to form a toner image; and transferring means for transferring the toner image formed on the image bearing body onto the recording material, the operation condition caused to be different by the control means when the image is re-formed being at least one of a charged electric potential of the image bearing body and a voltage applied during developing between the image bearing body and the developing means.

According to the above arrangement, the printing density of a toner image can easily be changed. Also, it is possible to simplify the process and thereby to shorten the processing time in comparison, for example, with the arrangement in which the printing density of a toner image is modified by performing an image process on the image data.

Yet further, the operation condition caused to be different by the control means when the image is re-formed may be a temperature of the fixing means during forming of the image.

According to the above arrangement, by changing a temperature of the fixing means applied during forming of the image, a peeling characteristic of the recording material with respect to the fixing means can be improved, and the possibility that a feeding error occurs in the fixing means can thereby be reduced.

Furthermore, the operation condition caused to be different by the control means when the image is re-formed may be a feeding speed of the recording material.

According to the above arrangement, by changing a feeding speed of the recording material, the possibility that a feeding error occurs in the fixing means can be reduced.

The image forming apparatus of the present invention may further include: storing means for storing an order of priorities of the operation condition caused to be different by the control means when the image is re-formed, the control means determining, based on the frequency of having performed re-forming and the order of priorities, the operation condition caused to be different by the control means when the image is re-formed.

According to the above arrangement, since it is possible to change a condition each time a feeding error occurs, the possibility that a feeding error recurs in the fixing means during reprinting process can be reduced, and deterioration in image quality can be minimized.

The image forming apparatus of the present invention may be arranged such that the storing means stores a determination criterion for determining whether or not it is necessary to change each of the operation conditions caused to be different by the control means when the image is re-formed, and the controlling means chooses, in accordance with the determination criterion, which operation conditions should be changed, and determines, based on (i) a chosen result, (ii) the frequency of having performed re-forming and (iii) the order of priorities, the operation condition caused to be different by the control means when the image is re-formed.

According to the above arrangement, since it is possible to choose a condition necessary to be changed and then change the condition in accordance with the order of priorities each time a feeding error occurs, the possibility that a feeding error recurs in the fixing means during reprinting process can be reduced effectively, and deterioration in image quality can be minimized.

The image forming apparatus of the present invention may further include storing means for storing a determination criterion for determining whether or not it is necessary to change each of the operation conditions caused to be different by the control means when the image is re-formed, and the controlling means choosing, in accordance with the determination criterion, which operation conditions should be changed, and further choosing, from among the operation conditions thus chosen, the operation condition caused to be different by the control means when the image is re-formed.

According to the above arrangement, since the controlling means chooses a condition necessary to be changed and then chooses, from among the operation conditions thus chosen, the operation condition caused to be different by the control means when the image is re-formed, the possibility that a feeding error recurs in the fixing means during reprinting process can be reduced effectively, and deterioration in image quality can be minimized.

The image forming apparatus of the present invention may further include notifying means for notifying a user that a feeding error has occurred due to malfunction of the image forming apparatus, the controlling means, when unable to avoid occurrence of a feeding error even after performing a predetermined frequency of having performed re-forming, controlling the notifying means so that the notifying means notifies that the feeding error is caused by malfunction of the image forming apparatus. The notifying means may be formed in any arrangement that can notify that a feeding error occurred due to malfunction in the image forming apparatus, and therefore be realized, for example, by image displaying means, sound outputting means or other notifying means for turning on or blinking a predetermined lamp or the like, included in the image forming apparatus.

According to the above arrangement, in the case where a feeding error occurs due to malfunction in the image forming apparatus, a user can properly be notified of the foregoing.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus for forming on a recording material an image corresponding to image data, the image forming apparatus comprising:

feeding means for feeding a recording material;

image forming means for forming a toner image corresponding to image data, and for transferring the toner image onto the recording material; and fixing means for fixing on the recording material the toner image that was transferred by said image forming means, said image forming apparatus, further comprising:

control means, when a feeding error of a recording material occurs in the fixing means and then an image corresponding to image data which was formed on the recording material which caused the feeding error of the recording material is re-formed on another recording material, for causing an operation condition which affects a peeling characteristic of the recording material with respect to the fixing means among operation conditions under which said each means works when an image is formed to be changed to an operation condition which improves the peeling characteristic of the recording material with respect to the fixing means than an operation condition used when the feeding error has occurred, the operation condition which affects the peeling characteristic of the recording material being at least two operation conditions among the following operation conditions: an operation condition for changing a width, extending in a recording material feeding direction, of a region on which no image is formed in an end part of the recording material upstream in the recording material feeding direction; an operation condition for changing a printing density of the toner image to be transferred onto recording material; a temperature of said fixing means during forming of the image; and a feeding speed of the recording material; and storing means for storing an order of priorities of the operation condition caused to be different by said control means when the image is re-formed, said control means successively changing the operation condition caused to be different by said control means when the image is re-formed, the operation condition being successively changed one by one every time re-forming is performed, based on the frequency of having performed re-forming and the order of priorities each time re-forming is performed.

2. The image forming apparatus according to claim 1, wherein:

the operation condition which affects the peeling characteristic of the recording material includes an operation condition for changing a width, extending in a recording material feeding direction, of a region on which no image is formed in an end part of the recording material upstream in the recording material feeding direction, said feeding means includes timing controlling means for sending out the recording material at a predetermined timing to a transfer position where a toner image is transferred, and the operation condition for changing the width, extending in a recording material feeding direction, of the region on which no image is formed in the end part of the recording material upstream in the recording material feeding direction is timing at which the recording material is sent out from said timing controlling means to the transfer position.

3. The image forming apparatus according to claim 1, wherein:

the operation condition which affects the peeling characteristic of the recording material includes an operation condition for changing a printing density of the toner image to be transferred onto recording material, said image forming means includes:

an image bearing body;

charging means for charging the image bearing body;

latent image forming means for forming an electrostatic latent image corresponding to the image data on the image bearing body charged by said charging means;

developing means for developing by use of toner the electrostatic latent image formed on the image bearing body so as to form a toner image; and transferring means for transferring the toner image formed on the image bearing body onto the recording material, the operation condition for changing the printing density of the toner image to be transferred onto recording material being at least one of a charged electric potential of the image bearing body and a voltage applied during developing between said image bearing body and said developing means.

4. The image forming apparatus according to claim 1, wherein:

said storing means stores a determination criterion for determining whether or not it is necessary to change each of the operation conditions to be different by said control means when the image is re-formed, and said control means chooses, in accordance with the determination criterion, which operation conditions should be changed among the operation conditions which affect the peeling characteristic of the recording material, and successively changes, based on (i) its chosen result, (ii) the frequency of having performed re-forming and (iii) the order of priorities, the operation condition thus chosen, the operation condition being successively changed one by one every time re-forming is performed.

5. The image forming apparatus according to claim 1, further comprising notifying means for notifying a user that a feeding error has occurred due to malfunction of the image forming apparatus, said control means, when unable to avoid occurrence of a feeding error even after performing a predetermined frequency of having performed re-forming, controlling said notifying means so that the notifying means notifies that the feeding error is caused by malfunction of the image forming apparatus.

6. An image forming apparatus for forming on a recording material an image corresponding to image data, the image forming apparatus comprising:

feeding means for feeding a recording material;

image forming means for forming a toner image corresponding to image data, and for transferring the toner image onto the recording material; and fixing means for fixing on the recording material the toner image that was transferred by said image forming means, said image forming apparatus, further comprising:

control means, when a feeding error of a recording material occurs in the fixing means and then an image corresponding to image data which was formed on the recording material which caused the feeding error of the recording material is re-formed on another recording material, for causing an operation condition which affects a peeling characteristic of the recording material with respect to the fixing means under which said each means works when an image is formed to be changed to an operation condition which improves the peeling characteristic of the recording material with respect to the fixing means than an operation condition used when the feeding error has occurred, the operation condition which affects the peeling characteristic of the recording material being at least two operation conditions among the following operation conditions: an operation condition for changing a width, extending in a recording material feeding direction, of a region on which no image is formed in an end part of the recording material upstream in the recording material feeding direction; an operation condition for changing a printing density of the toner image to be transferred onto recording material; a temperature of said fixing means during forming of the image; and a feeding speed of the recording material; and storing means for storing a determination criterion for determining whether or not it is necessary to change each of the operation conditions to be different by said control means when the image is re-formed, said control means choosing, in accordance with the determination criterion, which operation conditions should be changed, and further choosing, from among the operation conditions thus chosen, the operation condition caused to be different by said control means when the image is re-formed.

7. An image forming method for forming on a recording material an image corresponding to image data by use of an image forming apparatus, the image forming apparatus comprising:

feeding means for feeding a recording material;

image forming means for forming a toner image corresponding to image data, and for transferring the toner image onto the recording material; and fixing means for fixing on the recording material the toner image that was transferred by said image forming means on the recording material, which image was transferred onto the recording material, said image forming method comprising the steps of:

when a feeding error of a recording material occurs in the fixing means and then an image corresponding to image data which was formed on the recording material which caused the feeding error of the recording material is re-formed on another recording material, causing an operation condition which affects a peeling characteristic of the recording material with respect to the fixing means among operation conditions under which said each means works when an image is formed to be changed to an operation condition which improves the peeling characteristic of the recording material with respect to the fixing means than an operation condition used when the feeding error has occurred, the operation condition which affects the peeling characteristic of the recording material being at least two operation conditions among the following operation conditions: an operation condition for changing a width, extending in a recording material feeding direction, of a region on which no image is formed in an end part of the recording material upstream in the recording material feeding direction; an operation condition for changing a printing density of the toner image to be transferred onto recording material; a temperature of said fixing means during forming of the image; and a feeding speed of the recording material;

storing an order of priorities of the operation condition caused to be different in a control means when the image is re-formed; and successively changing the operation condition caused to be different by said control means when the image is re-formed, the operation condition being successively changed one by one every time re-forming is performed, based on the frequency of having performed re-forming and the order of priorities each time re-forming is performed.

8. An image forming method for forming on a recording material an image corresponding to image data by use of an image forming apparatus, the image forming apparatus comprising:

feeding means for feeding a recording material;

image forming means for forming a toner image corresponding to image data, and for transferring the toner image onto the recording material; and fixing means for fixing on the recording material the toner image that was transferred by said image forming means, said image forming method comprising the steps of:

when a feeding error of a recording material occurs in the fixing means and then an image corresponding to image data which was formed on the recording material which caused the feeding error of the recording material is re-formed on another recording material, causing an operation condition which affects a peeling characteristic of the recording material with respect to the fixing means among operation conditions under which said each means works when an image is formed to be changed to an operation condition which improves the peeling characteristic of the recording material with respect to the fixing means than an operation condition used when the feeding error has occurred, the operation condition which affects the peeling characteristic of the recording material being at least two operation conditions among the following operation conditions: an operation condition for changing a width, extending in a recording material feeding direction, of a region on which no image is formed in an end part of the recording material upstream in the recording material feeding direction; an operation condition for changing a printing density of the toner image to be transferred onto recording material; a temperature of said fixing means during forming of the image; and a feeding speed of the recording material;

storing a determination criterion for determining whether or not it is necessary to change each of the operation conditions to be different in a control means when the image is re-formed;

choosing, in accordance with the determination criterion, which operation conditions should be changed; and choosing, from among the operation conditions thus chosen, the operation condition caused to be different by said control means when the image is re-formed.

* * * * *